US006375585B1

(12) United States Patent
Driscoll

(10) Patent No.: US 6,375,585 B1
(45) Date of Patent: Apr. 23, 2002

(54) ADJUSTABLE GOALPOST ASSEMBLY

(75) Inventor: Timothy W. Driscoll, Devon, PA (US)

(73) Assignee: Aluminum Athletic Equipment Co., Conshohocken, PA (US)

( * ) Notice: Subject to any disclaimer, the term of this patent is extended or adjusted under 35 U.S.C. 154(b) by 13 days.

(21) Appl. No.: 09/591,467

(22) Filed: Jun. 9, 2000

(51) Int. Cl.[7] ..... A63B 63/00
(52) U.S. Cl. ..... 473/477; 384/53
(58) Field of Search ..... 473/477, 454, 473/453, 456; 212/310; 280/33.992; 414/11; 403/61, 65, 79

(56) References Cited

U.S. PATENT DOCUMENTS 2,929,630 A * 3/1960 Simmons ..... 473/477
3,516,666 A * 6/1970 Trimble et al. ..... 473/477
3,856,302 A * 12/1974 Karkoska ..... 473/477
3,908,992 A * 9/1975 Cunningham et al. ..... 473/477
3,917,263 A * 11/1975 Wiley ..... 473/433
3,981,501 A * 9/1976 Gonzalez et al. ..... 473/477
5,348,291 A * 9/1994 Scully ..... 473/454

OTHER PUBLICATIONS

Rogers Athletic Company 1998 catalog *For the Perfection of Football Fundamentals* ™, p. 32.

* cited by examiner

*Primary Examiner*—Paul T. Sewell
*Assistant Examiner*—M. Chambers
(74) *Attorney, Agent, or Firm*—Volpe & Koenig, P.C.

(57) ABSTRACT

A trolley assembly for adjusting the position of an upright along a cross-bar. The trolley assembly comprises a frame assembly, an upright support extending from the frame assembly, at least one roller assembly secured within the frame assembly and adapted to travel along the cross-bar, and a lock. The lock is moveable between an open position wherein the frame assembly is moveable relative to the cross-bar and a locked position wherein the frame assembly is fixed relative to the cross-bar.

6 Claims, 3 Drawing Sheets

ADJUSTABLE GOALPOST ASSEMBLY

BACKGROUND

The present invention relates to sports goals. More particularly, the present invention relates to an adjustable goalpost assembly.

American football games include the opportunity at various times for a player to kick the football through a goalpost to receive points. The goalposts generally comprise a support post, a cross-bar, and a pair of spaced apart uprights. To receive the points, the kicked football must travel over the cross-bar and between the uprights. As such, it is important that the kicker be capable of kicking the football with accuracy between the uprights.

To develop consistent accuracy, kickers practice during non-game situations kicking the football through the uprights from various distances and at different angles relative to the position of the goalpost. To achieve greatest accuracy, the kickers attempt to focus on kicking the football through a small area in the center of the space between the uprights. The kickers must use their imagination to define such an area in their mind's eye.

Even if a kicker becomes consistent at kicking the football through the goalpost in a practice situation, there is generally greater pressure during an actual game. As a result of such pressure, it is often difficult for a kicker to maintain the same consistency and accuracy. Games are often lost by a kicker kicking the football just to the left or right of the respective goalpost upright.

It is an advantage for kickers to practice on a goalpost assembly wherein the uprights are positioned closer together than standard uprights. By practicing with such, the kickers can more easily visualize a central kicking area. Additionally, if a kicker becomes consistently accurate on narrower uprights during practice, kicking towards the wider, regulation uprights during a game situation may seem easier. This may help compensate for the added pressure of kicking in a game situation.

To provide kickers with such assistance, teams have had goalposts with narrower uprights custom built for practice purposes. However, different kickers may desire the narrowing of the uprights by differing amounts. Additionally, some programs may not be able to afford, or have the space for, separate game goalposts and practice goalposts. Furthermore, some facilities are used by both high school and college teams, which have different regulations for the space between the uprights, the high school uprights being space further apart than the college uprights. As such, a facility could be required to have up to four different goalpost configurations, i.e.—high school and college regulation width and high school and college narrower width.

Accordingly, there is a need for a goalpost assembly which allows the space between the uprights to be adjusted to any desired width.

SUMMARY

The present invention provides a trolley assembly for adjusting the position of an upright along a cross-bar. The trolley assembly comprises a frame assembly adapted to overly the cross-bar, an upright support extending from the frame assembly, at least one roller assembly secured within the frame assembly and adapted to travel along the cross-bar, and a lock. The lock is moveable between an open position wherein the frame assembly is moveable relative to the cross-bar and a locked position wherein the frame assembly is fixed relative to the cross-bar.

BRIEF DESCRIPTION OF THE DRAWING(S)

DETAILED DESCRIPTION OF THE PREFERRED EMBODIMENT(S)

Figure 1:
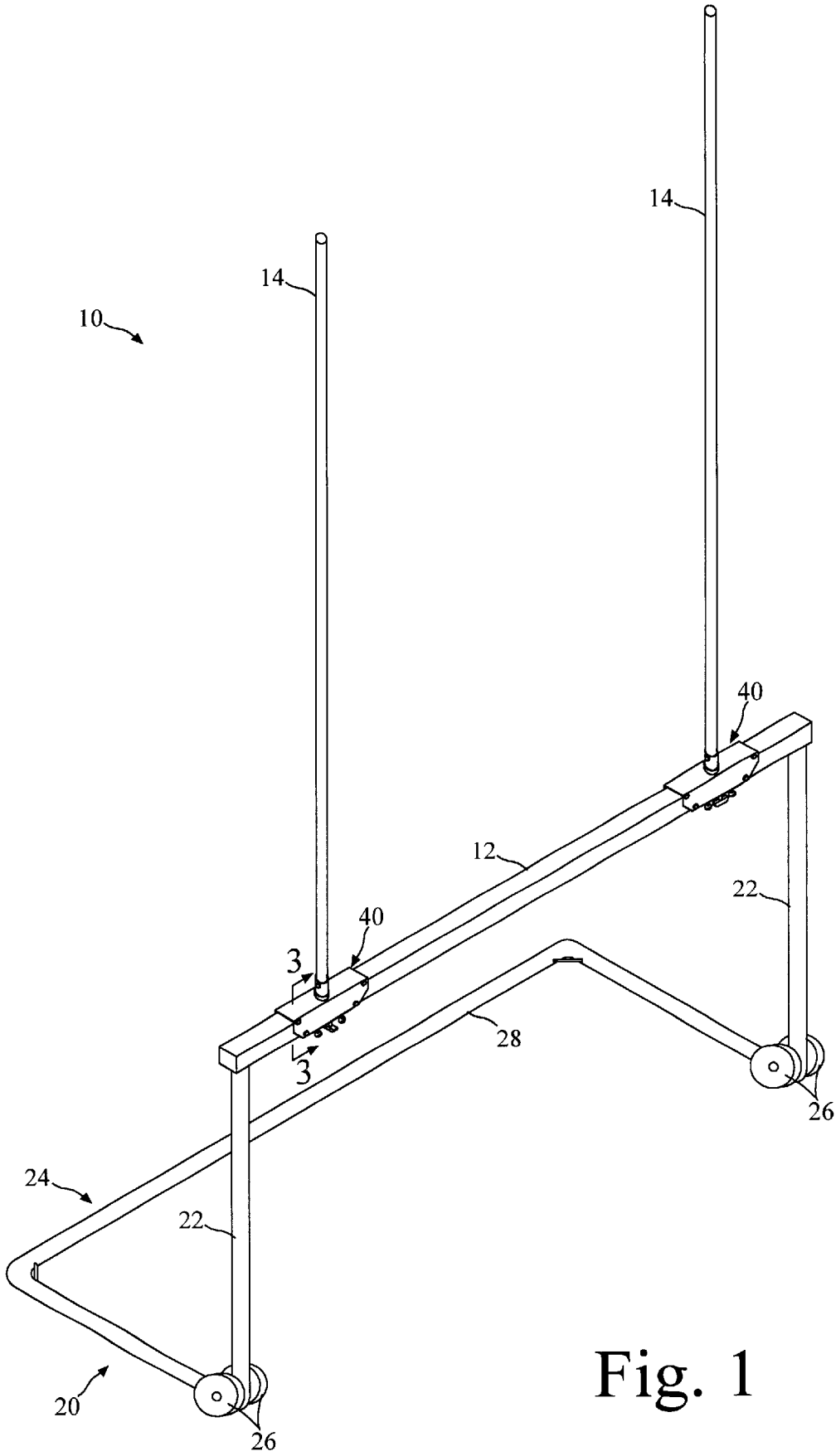
FIG. 1 is an isometric view of a first embodiment of the present invention.
Figure 2:
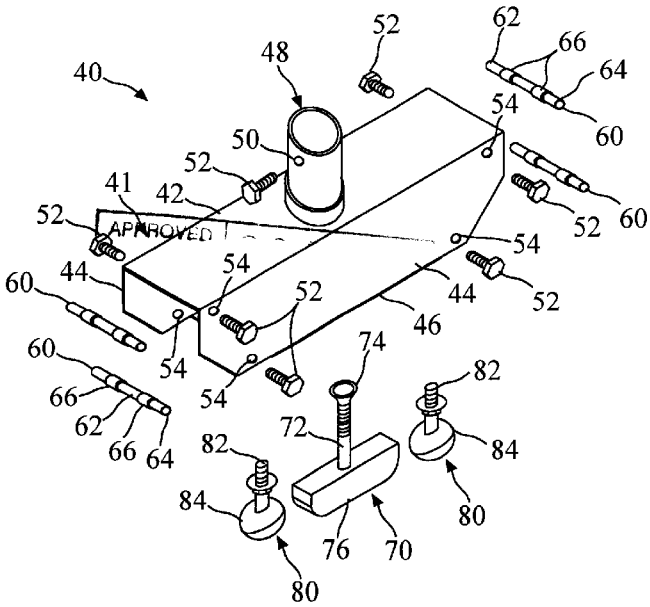
FIG. 2 is an exploded, isometric view of a trolley assembly of the first embodiment of the present invention.
Figure 3:
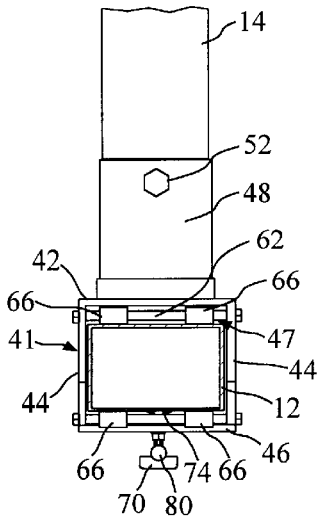
FIG. 3 is a sectional view along the line 3—3 in FIG. 1.
Figure 4:
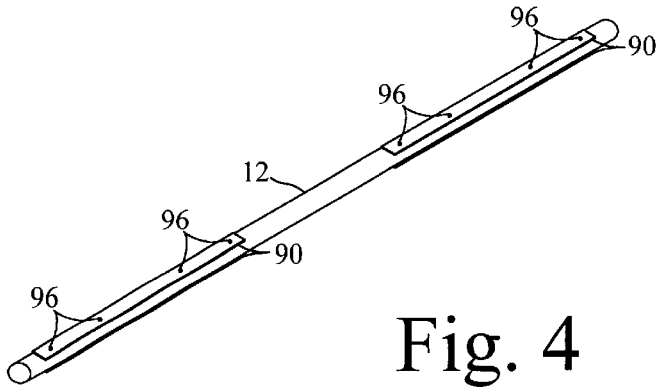
FIG. 4 is an isometric view of a cross bar with plates secured thereto for use with the present invention.

The preferred embodiments of the present invention will be described with reference to the drawing figures where like numerals represent like elements throughout.

Referring to FIGS. 1–4, a first embodiment 10 of the present invention is shown. The goalpost assembly 10 includes a vertical support assembly 20, a cross-bar 12 and uprights 14. The vertical support assembly 20 includes a pair of vertical posts 22 extending down from the cross-bar 12 and attached to a horizontal frame assembly 24. The rear member 28 of the horizontal frame assembly 24 is preferably weighted to sufficiently stabilize the structure. Wheel assemblies 26 are preferably provided adjacent to the horizontal frame assembly 24 to allow transport of the goalpost 10, for example, to a storage area when not in use.

A pair of trolley assemblies 40 are mounted for movement along the cross-bar 12. Each trolley assembly 40 preferably includes a frame 41 defined by top and bottom plates 42 and 46 and a pair of side walls 44 extending therebetween. The frame 41 has a passage 47 therethrough which has a configuration slightly larger than, but substantially the same as that of the cross-bar 12. In the present embodiment, the cross-bar 12 and passage 47 have rectangular configurations, however, other configurations, for example, oval, elliptical, I-beam, channel, etc., are possible. The rectangular configuration is preferable as it is easy to manufacture and resists rotation of the trolley assembly 40.

A plurality of roller assemblies 60 extend across the passage 47 between the opposed side walls 44. In the preferred embodiment, each roller assembly 60 includes an axle 62 with bores 64 at each end. The bores 64 align with holes 54 in the frame side walls 44 and are secured by bolts 52 or the like. Other mounting methods may also be used. One or more rollers 66 is positioned on each axle 62 and secured by clips or the like (not shown). The roller assemblies 60 are preferably positioned at each end of the frame 41, with one roller assembly 60 adjacent the top plate 42 and one adjacent the bottom plate 46. More or fewer assemblies may be utilized. The roller assemblies 66 are spaced such that the rollers 66 roll smoothly along the cross-bar 12.

A locking handle 70 extends through the bottom plate 46 of each trolley assembly 40. It may be positioned in any of the other frame members 42, 44, but is most accessible from the bottom plate 46. The preferred locking handle 70 includes a threaded shaft 72 with a handle member 76 at one end and a pressure pad 74 at the other. The trolley assembly 40 is moved along the cross-bar 12 on the roller assemblies 60 until positioned in a desired location. Once situated, the locking handle 70 is rotated until the pressure pad 74 engages the cross-bar with sufficient force to secure the trolley assembly 40. Repositioning of the uprights 14 is accomplished by loosening the locking handles 70 and moving the trolley assemblies 40.

To assist sliding movement of the trolley assemblies 40, each trolley assembly 40 preferably includes a pull handle 80 secured proximate each end of the bottom plate 46. Each pull handle 80 includes an attachment portion 82 and a handle portion 84. Although the locking handle 70 could be used to move the trolley assembly 40, the additional pull handles 80 are preferred as their positions proximate the ends of the bottom plate 46 allow a more direct force and facilitate easier movement.

An upright support 48 extends from the top plate 42 of each trolley assembly 40. The support 48 is dimension to receive an upright 14. A bolt 52 or the like may be threaded through a hole 50 in the support 48 to secure the upright 14. In some applications, for example, for college stadiums, it may be desirable to provide dual color uprights 14, i.e. painted white on one hemisphere and yellow on the other hemisphere. College football regulations allow a stadium to use either white uprights or yellow uprights. To allow a kicker to practice while looking at the appropriate color for the upcoming game, each dual color upright 14 can easily be rotated in the upright support 48 and secured with the appropriate color facing the kicker.

In applications utilizing a non-rectangular cross-bar 12, it may be desirable to attach conversion plates 90 to the cross-bar 12 to provide a preferable surface for the trolley assemblies. The plates 90 can be secured about the cross-bar via, bolts 96, straps or the like.

Figure 5:
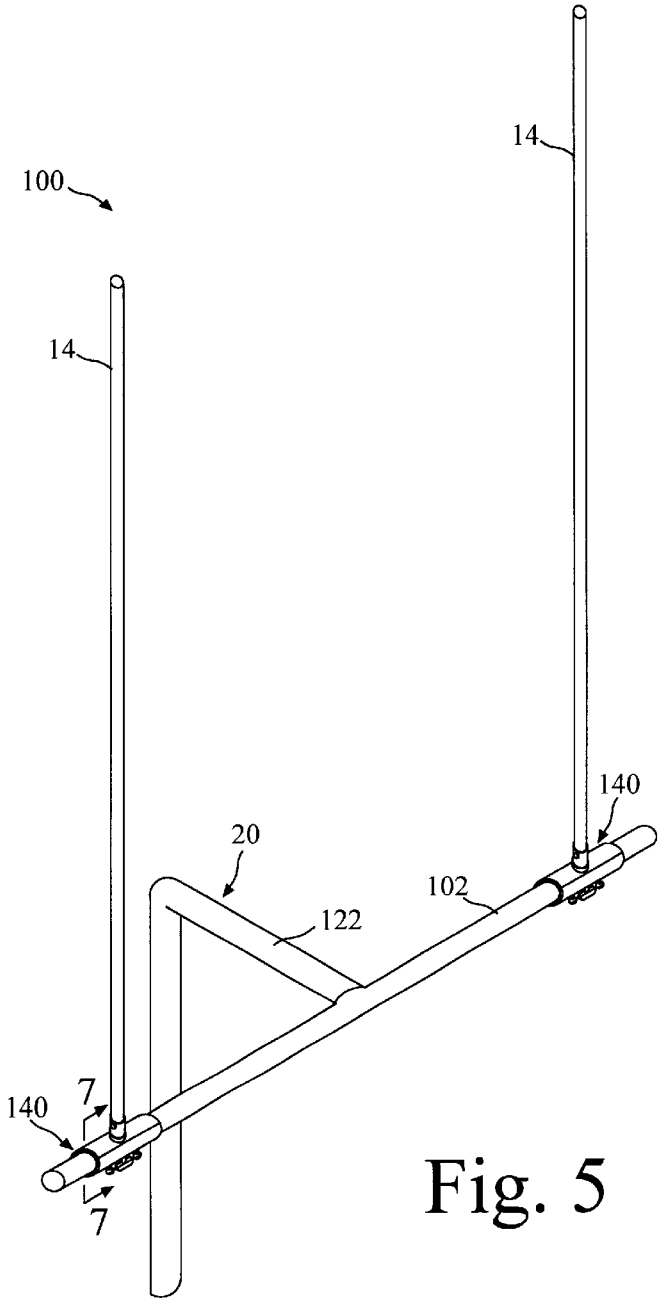
FIG. 5 is an isometric view of a second embodiment of the present invention.
Figure 6:
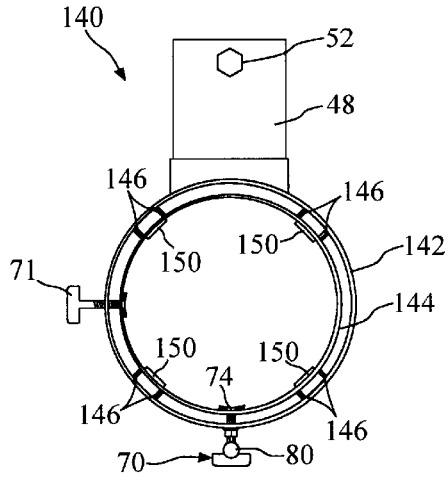
FIG. 6 is an elevational view of a trolley assembly of the second embodiment of the present invention.
Figure 7:
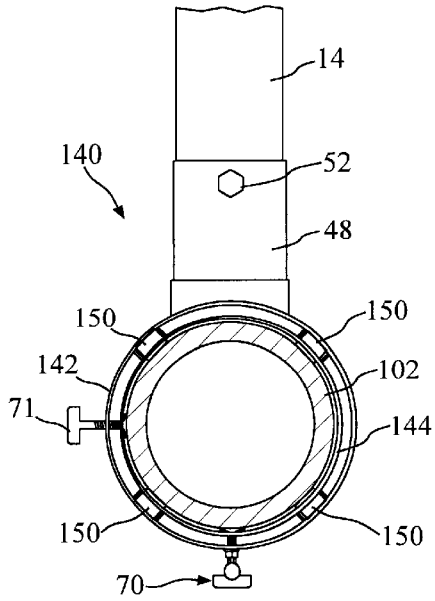
FIG. 7 is a sectional view along the line 7—7 in FIG. 5.

Referring to FIGS. 5–7, an alternate embodiment 100 of the present invention is shown. The goalpost assembly 100 also includes a vertical support assembly 20, a cross-bar 102 and uprights 14. The vertical support assembly 20 includes a single L-shaped post 122 attached to the cross-bar 102. In this embodiment, the cross-bar 102 has a round cross-section. The L-shaped post 122 can also be used with the non-round cross-bar 12 of the previous embodiment and the horizontal and vertical support assembly 20 of the previous embodiment can be used with the round cross-bar 102 of this embodiment.

As in the previous embodiment, each upright 14 is secured in an upright support 48 extending from a trolley assembly 140. The trolley assemblies 140 are similar to those of the first embodiment, but have a round configuration to complement that of the cross-bar 102. Each trolley assembly 140 includes an outer cylindrical body 142 and at least one support ring 144 supported within the outer body 142 by supports 146. A plurality of barrel bearings 150, having a substantially cylindrical shape, are positioned between the outer cylindrical body 142 and the support ring 144 and extend through respective holes (not shown) through the support ring 144. Each barrel bearing 150 is preferably positioned with its axis perpendicular to the axis of the cross-bar 102. As such, the barrel bearings 150 allow the trolley assembly 140 to roll along the length of the cross-bar 102, but offer some resistance to rotation of the trolley assembly 140. A locking handle 70 and a pair of pull handles 80 extend from each trolley assembly 140. One or more additional locking handles 71, spaced from the first, may be utilized to reduce the likelihood of rotation of the trolley assembly 140. Again, the trolley assemblies 140 are moved to their desired locations and secured by the locking handles 70, 71.

What is claimed is:

1. A goal post assembly comprising a vertical support assembly, a cross-bar supported thereby, and a pair of uprights extending upwardly from the cross-bar, at least one of the uprights secured to the cross-bar by a moveable trolley assembly for adjusting the position of an upright along the cross-bar, the trolley assembly comprising:

a frame assembly adapted to overly the cross-bar;

an upright support extending from the frame assembly;

at least one roller assembly secured within the frame assembly and adapted to travel along the cross-bar; and a lock which is moveable between an open position wherein the frame assembly is moveable relative to the cross-bar and a locked position wherein the frame assembly is fixed relative to the cross-bar.

2. The goal post assembly of claim 1 wherein each upright is secured to the cross-bar by a moveable trolley assembly.

3. The goal post assembly of claim 1 wherein the cross-bar has a rectangular cross-sectional configuration and a pair of the roller assemblies are secured to the frame assembly to define a rectangular passage which complements the cross-bar configuration.

4. The goal post assembly of claim 1 wherein the vertical support assembly includes a pair of spaced apart vertical posts, each post connected adjacent a first end to the cross-bar and adjacent a second end to a horizontal frame member.

5. The goal post assembly of claim 4 wherein the horizontal frame member has a u-shaped configuration.

6. The goal post assembly of claim 1 wherein the vertical support assembly includes at least one wheel assembly attached thereto to assist movement of the goal post assembly.

* * * * *

UNITED STATES PATENT AND TRADEMARK OFFICE

CERTIFICATE OF CORRECTION

PATENT NO. : 6,375,585 B1
DATED : April 23, 2002
INVENTOR(S) : Timothy W. Driscoll It is certified that error appears in the above-identified patent and that said Letters Patent is hereby corrected as shown below:

Column 4,
Line 24, delete “overly” and insert therefor -- overlay --.

Signed and Sealed this

Twentieth Day of August, 2002

*Attest:*

*Attesting Officer*

JAMES E. ROGAN
*Director of the United States Patent and Trademark Office*